US009764210B2

(12) United States Patent
Curtis et al.

(10) Patent No.: US 9,764,210 B2
(45) Date of Patent: Sep. 19, 2017

(54) GOLF CLUB HEAD WITH INTERNAL CAP

(71) Applicant: Cobra Golf Incorporated, Carlsbad, CA (US)

(72) Inventors: Andrew Curtis, San Diego, CA (US); Cameron J. Day, Aliso Vaiejo, CA (US); Caleb Kroloff, San Diego, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 133 days.

(21) Appl. No.: 14/639,573

(22) Filed: Mar. 5, 2015

(65) Prior Publication Data

US 2015/0306475 A1 Oct. 29, 2015

Related U.S. Application Data

(63) Continuation-in-part of application No. 14/261,974, filed on Apr. 25, 2014, now Pat. No. 9,433,836.

(51) Int. Cl.

| | |
|---|---|
| ***A63B 53/04*** | (2015.01) |
| ***A63B 53/06*** | (2015.01) |
| *A63B 60/02* | (2015.01) |

(52) U.S. Cl.

CPC ..... *A63B 53/06* (2013.01); *A63B 53/0466* (2013.01); *A63B 60/02* (2015.10); *A63B 2053/045* (2013.01); *A63B 2053/0433* (2013.01); *A63B 2053/0491* (2013.01)

(58) Field of Classification Search

CPC ..... A63B 53/06; A63B 53/0466; A63B 60/02; A63B 2053/0433; A63B 2053/045; A63B 2053/0491

USPC ..... 473/324–350, 287–292, 256

See application file for complete search history.

(56) References Cited

U.S. PATENT DOCUMENTS

| | | | |
|---|---|---|---|
| 2,098,445 | A | 11/1937 | Wettlaufer |
| 2,163,091 | A | 6/1939 | Held |
| 2,171,383 | A | 8/1939 | Wettlaufer |
| 2,198,981 | A | 4/1940 | Sullivan |
| 2,460,445 | A | 2/1949 | Bigler |
| 2,750,194 | A | 6/1956 | Clark |
| 3,199,874 | A | 8/1965 | Biasing |
| 3,556,533 | A | 1/1971 | Hollis |
| 3,610,630 | A | 10/1971 | Glover |

(Continued)

FOREIGN PATENT DOCUMENTS

| | | | |
|---|---|---|---|
| JP | 2760723 | B2 | 6/1998 |
| JP | 2006-320493 | A | 11/2006 |

*Primary Examiner* — Sebastiano Passaniti

(74) *Attorney, Agent, or Firm* — Brown Rudnick LLP; Mark S. Leonardo

(57) ABSTRACT

The invention provides a golf club head with an opening covered from within by a lightweight cap. The opening can be part of, e.g., a weight track. The club head includes a crown, sole, face, and hosel cooperating to define a hollow club head body comprising at least a first material. The club head has an opening through the hollow body. Part of an edge around the opening is provided by a first material and a cap member of a second material less dense than the first material is mounted e.g., by an adhesive to an inside surface of the hollow body and enclosing the opening. The described construction is easier to mold or cast that other forms featuring undercuts and does not unduly interfere with a club head center of gravity.

8 Claims, 15 Drawing Sheets

(56) References Cited

U.S. PATENT DOCUMENTS 3,652,094 A 3/1972 Glover
3,976,299 A 8/1976 Lawrence et al.
3,979,122 A 9/1976 Belmont
3,979,123 A 9/1976 Belmont
4,043,563 A 8/1977 Churchward
4,052,075 A 10/1977 Daly
4,313,607 A * 2/1982 Thompson ..... A63B 53/04 473/328
4,423,874 A 1/1984 Stuff, Jr.
4,695,054 A 9/1987 Tunstall
4,895,371 A 1/1990 Bushner
5,252,869 A 10/1993 Gordin
5,316,305 A 5/1994 McCabe
5,676,606 A 10/1997 Schaeffer et al.
5,688,189 A 11/1997 Bland
5,720,674 A 2/1998 Galy
5,735,754 A 4/1998 Antonious
5,769,737 A 6/1998 Holladay et al.
5,788,584 A 8/1998 Parente et al.
5,916,042 A 6/1999 Reimers
5,967,905 A 10/1999 Nakahara et al.
5,971,867 A 10/1999 Galy
6,015,354 A 1/2000 Ahn et al.
6,056,649 A 5/2000 Imai
6,089,994 A 7/2000 Sun
6,123,627 A 9/2000 Antonious
6,217,461 B1 4/2001 Galy
6,248,025 B1 6/2001 Murphy et al.
6,306,048 B1 10/2001 McCabe et al.
6,332,848 B1 12/2001 Long et al.
6,458,044 B1 10/2002 Vincent et al.
6,773,360 B2 8/2004 Willett et al.
6,811,496 B2 11/2004 Wahl et al.
6,890,267 B2 5/2005 Mahaffey et al.
6,994,637 B2 2/2006 Murphy et al.
7,059,973 B2 6/2006 Erickson et al.
7,125,344 B2 10/2006 Hocknell et al.
7,128,664 B2 10/2006 Onoda et al.
7,147,573 B2 12/2006 DiMarco
7,153,220 B2 12/2006 Lo
7,166,040 B2 1/2007 Hoffman et al.
7,166,041 B2 1/2007 Evans
7,186,190 B1 3/2007 Beach et al.
7,189,165 B2 3/2007 Yamamoto
7,201,669 B2 4/2007 Stites et al.
7,223,180 B2 5/2007 Willett et al.
7,273,423 B2 * 9/2007 Imamoto ..... A63B 53/0466 473/332
7,351,163 B2 4/2008 Shimazaki et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,452,286 B2 11/2008 Lin et al.
7,455,600 B2 11/2008 Imamoto et al.
7,462,110 B2 12/2008 Yamamoto
7,520,820 B2 4/2009 Dimarco
7,524,249 B2 4/2009 Breier et al.
7,530,904 B2 5/2009 Beach et al.
7,540,811 B2 6/2009 Beach et al.
7,568,985 B2 8/2009 Beach et al.
7,572,194 B2 8/2009 Yamamoto
7,578,753 B2 8/2009 Beach et al.
7,591,738 B2 9/2009 Beach et al.
7,611,424 B2 11/2009 Nagai et al.
7,611,425 B2 11/2009 Yeh
7,621,823 B2 11/2009 Beach et al.
7,632,194 B2 12/2009 Beach et al.
7,637,823 B2 12/2009 Shimazaki et al.
7,670,235 B2 3/2010 Lo
7,717,804 B2 5/2010 Beach et al.
7,717,805 B2 5/2010 Beach et al.
7,771,290 B2 8/2010 Bezilla et al.
7,771,291 B1 8/2010 Willett et al.
7,775,905 B2 8/2010 Beach et al.
7,806,782 B2 10/2010 Stites et al.
7,963,861 B2 6/2011 Beach et al.
8,016,694 B2 9/2011 Llewellyn et al.
8,066,584 B2 11/2011 Stites et al.
8,177,661 B2 5/2012 Beach et al.
8,192,303 B2 6/2012 Ban
8,197,357 B1 6/2012 Rice et al.
8,206,243 B2 6/2012 Stites
8,216,087 B2 7/2012 Breier et al.
8,235,843 B1 8/2012 Rice et al.
8,238,162 B2 8/2012 Hung et al.
8,262,507 B1 9/2012 Willett et al.
8,298,096 B2 10/2012 Stites et al.
8,337,319 B2 12/2012 Sargent et al.
8,414,422 B2 4/2013 Peralta et al.
8,425,348 B2 4/2013 Boyd et al.
8,444,505 B2 5/2013 Beach et al.
8,444,506 B2 5/2013 Watson et al.
8,496,541 B2 7/2013 Beach et al.
8,562,457 B2 10/2013 Beach et al.
8,579,725 B1 11/2013 Willett et al.
8,684,863 B2 4/2014 Bezilla et al.
9,180,349 B1 11/2015 Seluga et al.
9,238,162 B2 * 1/2016 Breier ..... A63B 53/0466
9,498,686 B2 * 11/2016 Moine ..... A63B 53/0466
2005/0181884 A1 8/2005 Beach et al.
2006/0122004 A1 6/2006 Chen et al.
2006/0240907 A1 10/2006 Latiri
2006/0240908 A1 10/2006 Adams et al.
2006/0287129 A1 12/2006 Billings
2007/0105646 A1 5/2007 Beach et al.
2007/0105648 A1 5/2007 Beach et al.
2007/0105654 A1 5/2007 Beach et al.
2007/0149315 A1 6/2007 Bennett et al.
2007/0249432 A1 10/2007 Wu
2008/0261715 A1 10/2008 Carter
2008/0261717 A1 10/2008 Hoffman et al.
2010/0048321 A1 2/2010 Beach et al.
2010/0075773 A1 3/2010 Casati, Jr.
2010/0331103 A1 12/2010 Takahashi et al.
2011/0009209 A1 * 1/2011 Llewellyn ..... A63B 53/0466 473/336
2012/0058838 A1 3/2012 Stites et al.
2013/0005502 A1 1/2013 Ferguson et al.
2013/0090185 A1 4/2013 Boyd et al.
2013/0150176 A1 6/2013 Takechi
2013/0165255 A1 6/2013 Bezilla et al.
2013/0190100 A1 7/2013 Oldknow et al.
2013/0190104 A1 7/2013 Boyd et al.
2013/0244808 A1 9/2013 Bennett et al.
2013/0260913 A1 10/2013 Beach et al.
2013/0267338 A1 10/2013 Boyd et al.
2013/0303304 A1 11/2013 Sato
2014/0038746 A1 2/2014 Beach et al.
2014/0057739 A1 2/2014 Stites et al.
2014/0080629 A1 3/2014 Sargent et al.

* cited by examiner

GOLF CLUB HEAD WITH INTERNAL CAP

CROSS-REFERENCE TO RELATED APPLICATION

This application is a continuation-in-part of U.S. application Ser. No. 14/261,974, filed Apr. 25, 2014, the contents of which are incorporated by reference.

FIELD OF THE INVENTION

The invention relates to golf club heads.

BACKGROUND

Most sports are characterized by uniform playing fields that must meet detailed regulations. In tennis, for example, the tennis court must be 78 feet long. Every run in baseball requires 360 feet of running-90 feet between each base. By contrast, every golf course is unique. A golf course can be designed to reflect and complement its natural setting. In fact, one of the reasons many people are fond of golf is for the opportunity to spend time outdoors in different beautiful places.

Just as every golf course is unique, so too is every person who plays. Some golfers naturally hit further and faster than others. One player may have trouble with shots that consistently fade to the right, while his buddy may be getting poor scores due to a consistent unintended hook.

Some golf clubs are adjustable, with the idea being that a golfer can tailor the club to his or her unique playing style. Unfortunately, adjustment mechanisms add complexity to club manufacturing, which increases costs. For example, a weight port or weight track with multiple internally-facing surfaces can be very difficult to form by molding or casting due to the challenges in removing the part from the complex 3D mold. Moreover, the adjustment mechanisms themselves require mass that adversely influences a club head's mass distribution.

SUMMARY

The invention provides a golf club head with a recess or opening for use in an adjustment mechanism and in which the recess or opening is covered from within by a lightweight cap. For example, the recess can provide a weight track along a sole of the club head as an open slot with edges to which a repositionable weight member can be mounted. The open slot is covered from within by a cap, which can be provided by a molded lightweight material cemented to an inside surface of the sole of the club head. The described construction is easy to mold or cast and minimizes mass in undesired locations of the club head. Since the open recess is straightforward to manufacture, the cost of the club head can be kept low. Since the lightweight cap does not adversely affect the mass distribution of the club head, the club head performs well, giving a golfer consistent shots with good ball flight characteristics. Thus a recess or opening in a club head, covered with a lightweight cap, can be used to provide a club head with an adjustment mechanism, such as a repositionable weight member. An adjustment mechanism can be used to adjust heel-toe weighting, helping a golfer correct a hook or slice. An adjustment mechanism can be used to move a club head center of gravity up-down or front-back, allowing golfers to increase shot distance or get better loft. Additionally moving mass backwards or outwards can increase a club head's moment of inertia about a vertical axis (relative to address) thereby making a club head more forgiving to off-center hits. Thus a golf club head of the invention can include an adjustment mechanism that allows the golf club to be tailored to a golfer's unique playing style, while also not adversely influence cost of performance of the club head.

In a preferred embodiment, the invention is used within a trench or track system within a sole of a club head. The sole may be made predominantly of a first material such as titanium or other suitable metal. To avoid manufacturing challenges and poor performance characteristics that would be associated with a metal trench featuring internal ledges and undercuts used for mounting a weight member to the weight track, the invention provides a trench system that is light and easy to manufacture. This may be accomplished using a "cap" that is designed to encapsulated the trench or track. The cap preferably includes a second material lighter than the first such as a polymer, plastic, composite, fabric, or other suitable material. The capped track or trench provides several advantages. One advantage is ease of casting, as the design removes all undercuts from the trench/track portion of the casting. All load bearing structures may be kept in the same locations or dimensions in this design as compared to a monolithic version. The described structure is much lighter than a corresponding monolithic structure and the weight savings can be used to locate the saved mass in preferable locations. The described design creates a "platform" that can be used in several different embodiments or features. Additionally, the described structure improves the sound of the club head relative to a monolithic construction.

The invention provides methods of manufacturing the described club heads. In one method, a club head component such as a sole is initially cast with two or more pockets to accept repositionable weights. A trench or opening is then cut through the casting, e.g., to decrease weight of the component or to connect the casted pockets. The trench or opening may be created by laser cutting. A cap is then fixed (e.g., epoxied) into the head to encapsulate the trench.

In certain aspects, the invention provides a golf club head that includes a crown, sole, face, and hosel cooperating to define a hollow club head body comprising at least a first material. The club head has an opening through the hollow body in which at least a portion of an edge around the opening is provided by the first material and a cap member mounted to an inside surface of the hollow body and enclosing the opening. The cap member may include a second material less dense than the first material. The cap member may be attached to the inside surface of the hollow body e.g., by a cement such as epoxy.

In some embodiments, the opening is contained within a recess and the recess is configured to retain an accessory. The recess may include a channel with interior walls. Preferably, the recess provides the channel within the sole of the club head and the golf club head further includes a weight member repositionably mounted within the channel. In a preferred embodiment, the channel extends from a forward portion of the sole proximal to the face to an aft portion of the sole distal to the face. At least a portion of the cap member may be spaced away from the inside surface of the sole to accommodate a portion of a mounting mechanism of the weight member in a space between the portion of the cap member and the inside surface of the sole.

In certain embodiments, the first material is a metal and the second material is a polymer. The opening may be in the sole and edges of the opening provide a track for a repositionable weight. The cap may define a box-shaped portion to accommodate the repositionable weight. The golf club head can include a weight member repositionably mounted in the opening, at least partially disposed within the box-shaped portion of the cap.

Aspects of the invention provide a golf club head with a hollow, wood-type club head body having a face, hosel, crown portion, and sole portion. An adjustment mechanism is accessible at the sole and extends into the club head body relative to the sole. The club head includes a cap member over the adjustment mechanism, attached to the club head body and recessed into the club head wherein the cap member houses the adjustment mechanism on the outside of an enclosed volume defined by the club head body and the cap member. The adjustment mechanism may include a weight track, e.g., extending in a fore-aft direction. The club head may include a repositionable weight member capable of being fixed at a plurality of positions along the weight track. In some embodiments, the weight track and the cap member cooperate to define an exposed ledge with an undercut. In certain embodiments, the adjustment mechanism includes a weight port recess and a removable weight member. The sole may be metal and the cap may be a lower-weight polymer fixed to the sole by an adhesive. The cap member may include one or more ribs or stiffening elements extending across or through the cap member to provide stiffness, improved hitting properties, sound tuning, or strength.

DETAILED DESCRIPTION

Figure 1:
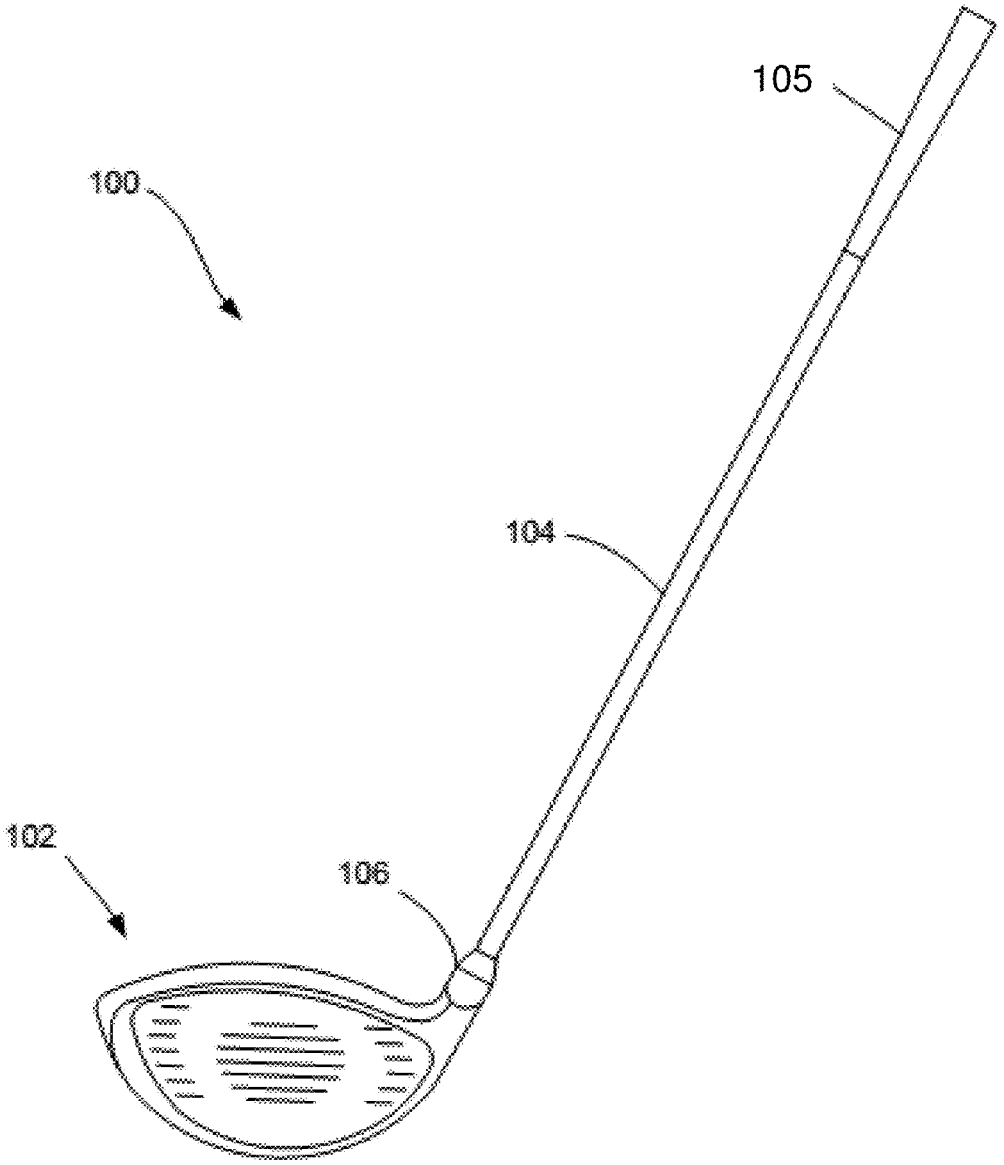
FIG. 1 shows a golf club with a wood-type golf club head of the invention.

FIG. 1 shows a golf club 100 with a wood-type golf club head 102 of the invention. Golf club 100 includes a shaft 104 and a grip 105 attached to one end of the shaft 102. The shaft 104 is connected to club head 102 at a hosel 106. The shaft 104 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. The grip 105 may be rubber materials, leather materials, other materials including cord or other fabric material embedded therein, polymeric materials, and the like.

Figure 2:
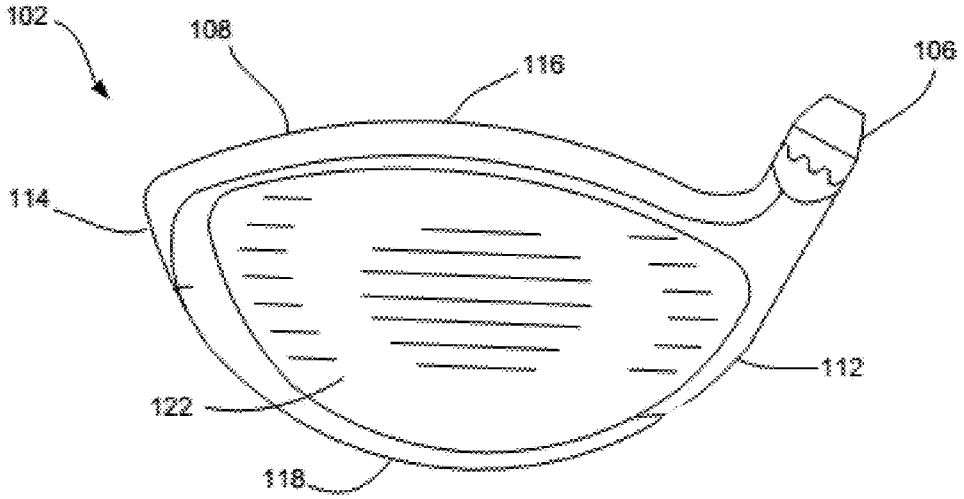
FIG. 2 gives a front view of club head of the invention.

FIG. 2 gives a front view of club head 102. Club head 102 includes a club head body 108 defined by a crown 116, a sole 118, and a ball-striking face 122 and further may be defined to include a heel portion 112 and a toe portion 114. Parts of the club head 102 described above may be made from multiple pieces that are connected together (e.g., by welding, adhesives, or other fusing techniques; by mechanical connectors; etc.). The various parts may be made from any suitable material such as metals such as steel, titanium and titanium alloys, aluminum and aluminum alloys, magnesium and magnesium alloys; composites, such as from carbon fiber composite materials; polymers; fiberglass composite materials, basalt fiber composite materials, polymer materials, etc. The various individual parts that make up a club head structure 102, if made from multiple pieces, may be engaged with one another or held together in any suitable or desired manner, including in conventional manners known and used in the art. For example, a separate ball-striking plate insert 122 may be joined to the ball-striking face 120 and a separate crown panel insert 124 may be joined to the club head body 108 (directly or indirectly through intermediate members) by adhesives, cements, welding, soldering, or other bonding or finishing techniques, and the like.

In some arrangements, the various parts of the club head 102 may be joined by mechanical connectors (such as threads, screws, nuts, bolts, or other connectors), and the like. In some embodiments, the mating edges of various parts of the club head structure 102 (e.g., the edges where heel, toe, crown, sole, ball-striking face, and/or other parts of the body contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

Figure 3:
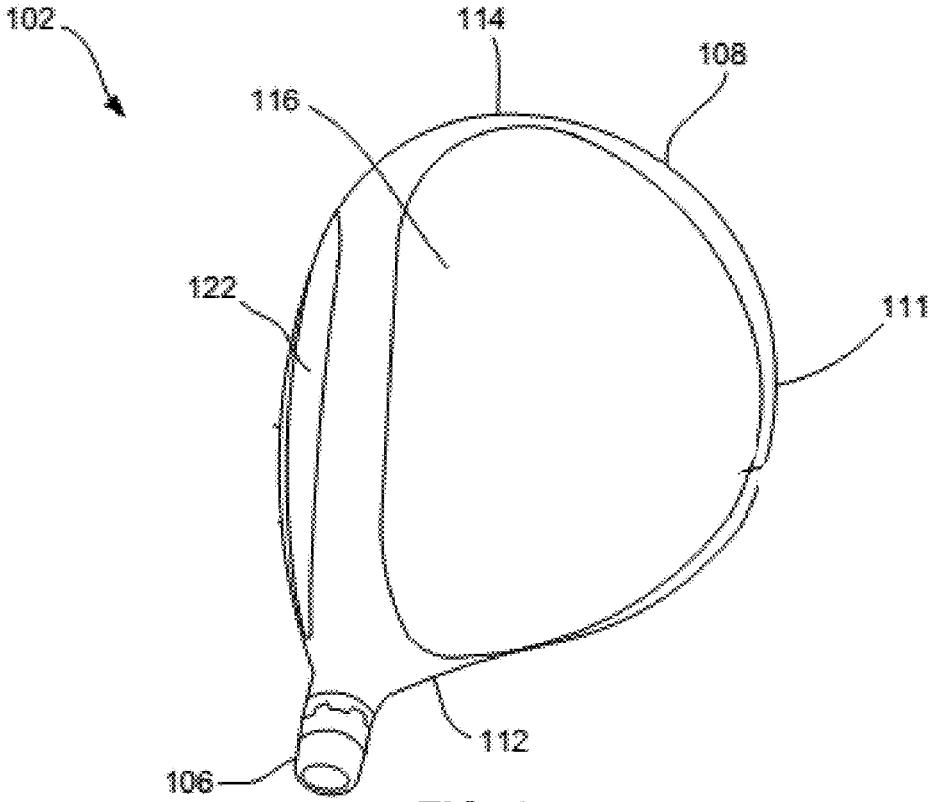
FIG. 3 gives a top view of club head.

FIG. 3 gives a top view of club head 102, showing the crown 116 extending back from the face 122 to an aft portion 111 of the club head.

Figure 4:
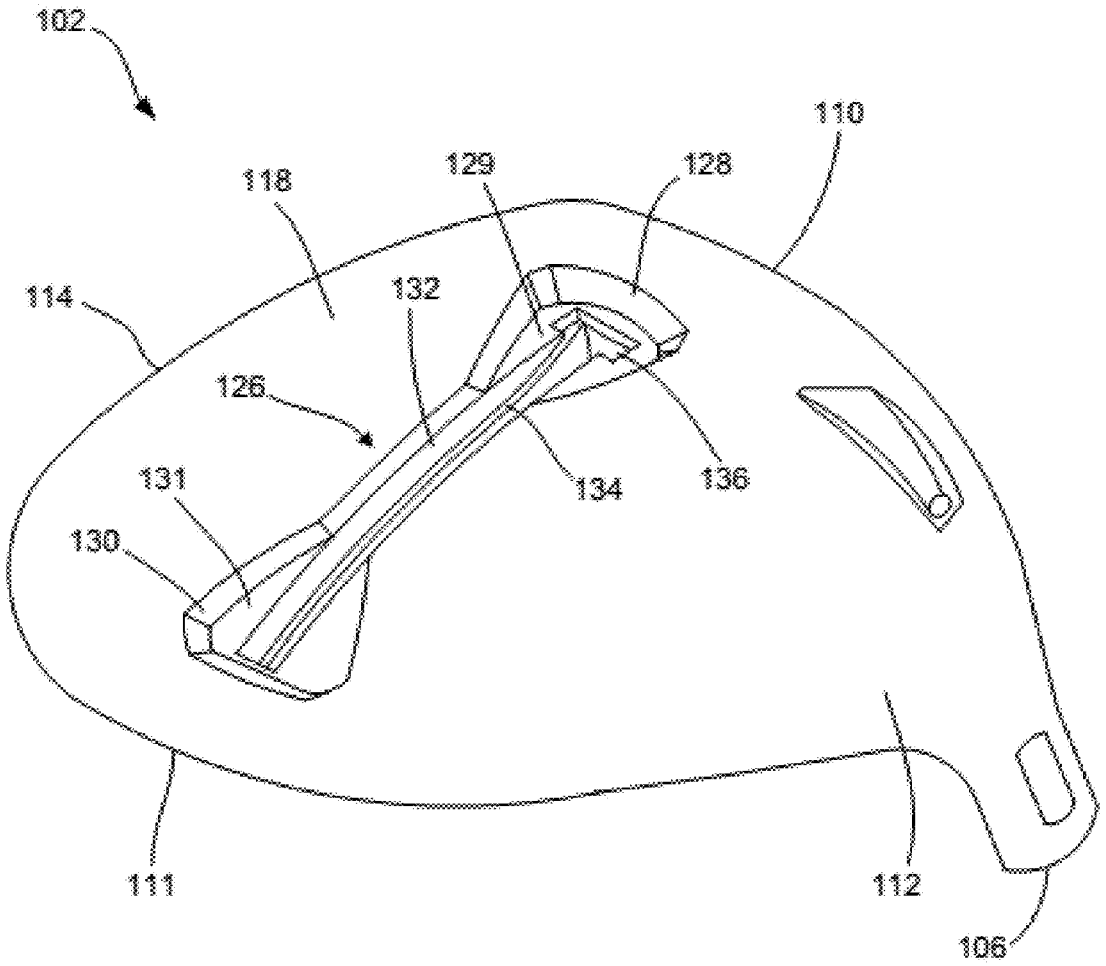
FIG. 4 shows a sole side of a golf club head of the invention.

FIG. 4 shows a sole side of a golf club head 102. As shown, the sole 118 has a track 126 formed along a length thereof extending from the front portion 110 to the rear portion 111 of the club head body 108. The track 126 includes a first end 128 adjacent to the front portion 110 and an opposing second end 130 adjacent to the rear portion 111. As described in greater detail herein, the first and second ends 128, 130 of the track 126 are shaped and/or sized to receive an adjustable weight assembly within (shown in FIGS. 5 & 6). As shown, the first end 128 and the second end 130 each have a support surface 129, 131, respectively, for supporting the weight assembly when the weight assembly is positioned therein.

As shown, the track 126 is generally linear and extends from the front portion 110 to the rear portion 111 of the club head 102. It should be understood, however, that a club head 102 consistent with the present disclosure may include any number of tracks 126 having any number of configurations, geometries, shapes, etc. For example, as described in greater detail herein, a club head according to some embodiments may include multiple tracks formed along different portions of the sole, resulting in a variety of different positions in which to mount a weight assembly, thereby providing multiple performance characteristics from which a golfer may choose. Track 126 further includes a channel 132 extending from an exterior surface of the sole 118 towards an internal cavity 138 of the club head body 108. The channel 132 lies along a plane that extends generally from the sole 118 to the crown 116 of the club head body 108. The channel 132 includes upper inner walls 133, inner sidewalls 135 extending from the upper inner walls 133 and towards a bottom inner wall 137. The inner walls 133, 135, 137 generally form a groove 134 that extends along length of the channel 132. The groove 134 lies along a plane that extends generally from the heel 112 to the toe 114 of the club head body 108, such that the plane along which the groove 134 lies is substantially orthogonal to the plane upon which the channel 132 lies.

The groove 134 is a shape and/or sized to receive a retaining member (e.g., washer, nut, etc.) therein by way of an entrance portion 136 formed proximate the first end 128 of the track. The entrance portion 136 is generally a portion of groove 134 in which side walls 135 of the channel 132 have been widened to allow a retaining member to pass into the groove 134. As described in greater detail herein, the weight assembly is coupled to the sole 118 by way of a fastening mechanism, including a mechanical fastener (e.g., bolt) extending through a portion of the weight assembly, into the channel 132, and engaging the retaining member positioned within the groove 134. Accordingly, the retaining member is adapted to retain the weight assembly along a portion of the sole 118 by way of engagement with the mechanical fastener. The retaining member is further adapted to slide along the groove so as to allow the weight assembly to move along a length of the track 126 when positioning the weight assembly, thereby allowing the weight assembly to remain coupled to the sole 118 during arrangement of the weight assembly, as described in greater detail herein.

As shown, the depth of the channel 132 may vary along a length of the track 126. For example, the channel 132 may be deeper at each of the first and second ends 128, 130 of the track 126 and may taper to a more shallow depth at or near a center point of the track 126 (at a position between the first and second ends 110, 111). For example, the channel 132 may include first and second ends 140, 142 adjacent the first and second ends 128, 130 of the track 126. The first and second ends 140, 142 may generally form pockets or bosses of empty space providing sufficient clearance for receipt of a portion of the mechanical fastener when the weight assembly is positioned within and secured to either of the first or second ends 128, 130, described in greater detail herein.

A golf club head 102 consistent with the present disclosure, including one or more parts (e.g., heel, toe, crown, sole, etc.), as well as separate components (e.g., fastener, retaining member, etc.) may be fabricated using an additive process, such as, powdered metal sintering and metal deposition. For example, the sole 118, including the track 126, the channel 132 and groove 134 formed therein, as well as the retaining member, can be fabricated via additive manufacturing processes, such that the retaining member is simultaneously formed within the groove as a result of the manufacturing processes, as described for example in Soracco et al. (U.S. Pat. No. 8,007,373), Soracco et al. (U.S. Patent Application Publication No. 2011/0277313), and Soracco et al. (U.S. Patent Application Publication No. 2013/0097050), the contents of each of which is incorporated by reference herein in its entirety.

One way to improve performance of the club, or accuracy, distance, etc. of a shot, is by adjusting mass distribution properties of the club head to one or more regions in order to adjust a center of gravity, mass moment of inertia, or swing weight of the club head. The track 126 provides a mechanism for adjusting the mass distribution properties of club head 102.

Figure 5:
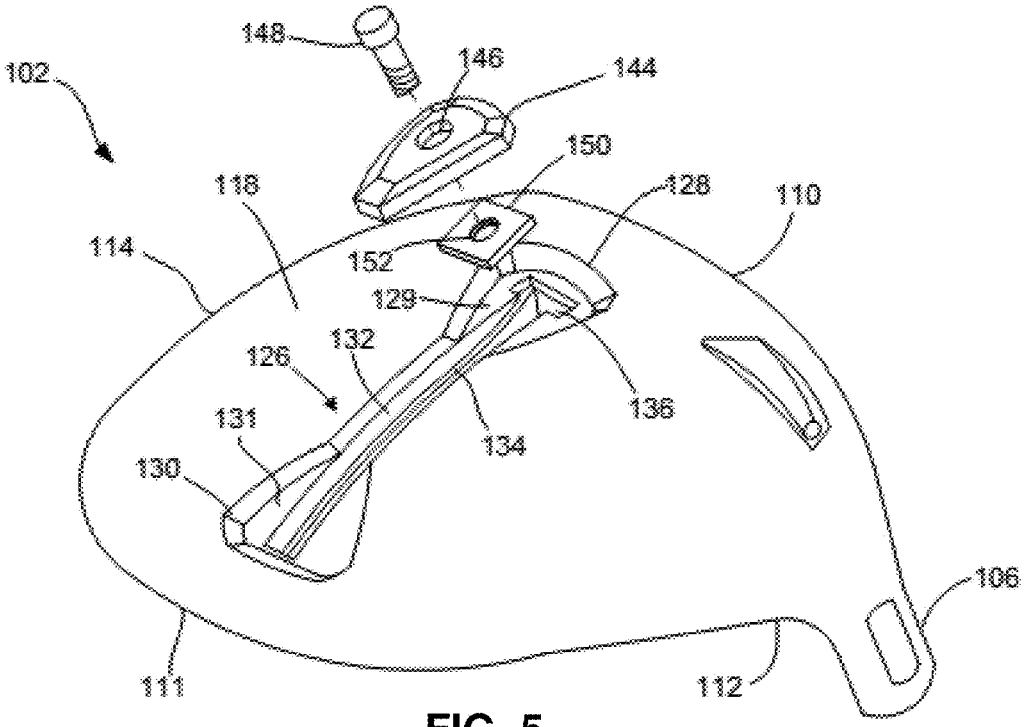
FIG. 5 is a perspective view of a golf club head of the invention.

FIG. 5 is a perspective view of a golf club head 102 illustrating the sole 118 and an adjustable weight assembly 144 for use with the track 126 formed on the sole 118. The weight assembly 144 is coupled to the sole 118, specifically the track 126, by way of an elongate mechanical fastener 148 extending through a portion of the weight assembly 144, into the channel 132, and engaging a portion of a retaining member 150. In the illustrated embodiment, the weight assembly 144 includes a bore 146 shaped and sized to receive the fastener 148. Similarly, the retaining member 150 includes a bore 152 shaped and sized to receive a portion of the fastener 148. In one embodiment, the fastener 148 includes external threading configured to engage an internally threaded bore 152 of the retaining member 150. In one embodiment, the fastener 148 is a bolt and the retaining member 150 is a nut or washer. It should be noted that the fastener 148 is not limited to a bolt, and may include any other type of suitable fastener, such as a barbed post, a cotter pin, or other binder.

The retaining member 150 is positioned within and retained by the groove 134 formed within the channel 132 of the track 126. The groove 134 is generally shaped and/or sized to allow the retaining member 150 to translate (e.g., slide) along a length of the groove 134 from the first end 128 of the track 126 to the second end 130 of the track 126. Accordingly, upon extending the fastener 148 through a portion of the weight assembly 144, into the channel 132, and in engagement with the retaining member 150 (which is positioned within the groove 134), the weight assembly 144 is adapted to move along a length of the track 126 between a first position and a second position, and any intermediate positions in between, while remaining coupled to the sole 118 at any position.

Figure 6:
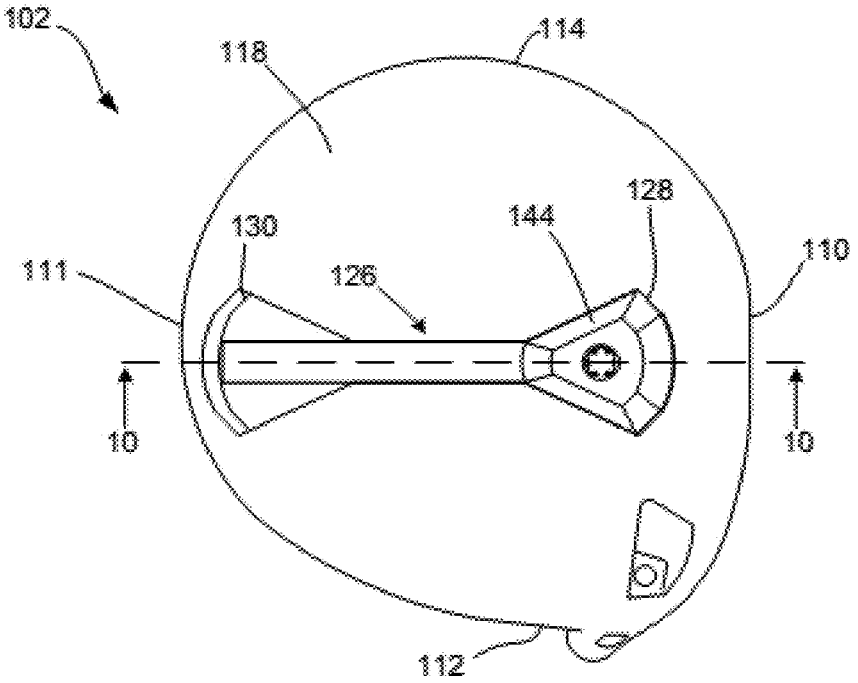
FIG. 6 is a bottom view of the golf club head with a weight assembly.

FIG. 6 is a bottom view of the golf club head 102 illustrating the weight assembly 144 in a first position along the sole 118 according to some embodiments.

Figure 7:
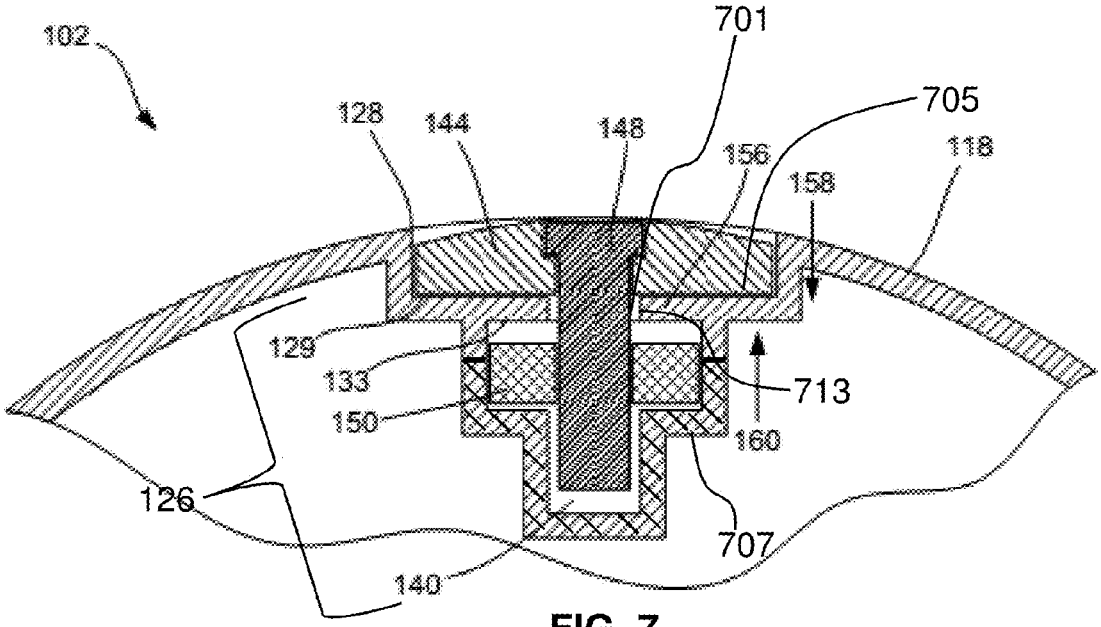
FIG. 7 shows a cross-section through the weight assembly in a recess.

FIG. 7 shows a cross-section through the weight assembly 144 of club head 102 (e.g., with the weight assembly 144 secured within the first end 128 of the track 126 as shown in FIG. 6). The cross-sectional view of FIG. 7 reveals that the sole 118, which includes a first material, has an opening 701. The opening 701 would be hole through the sole 118 into the inside of the club head 102 except that the opening 701 is covered by a cap member 707. The opening 701 is defined by an edge 713 of the first material. The cap member 707 is mounted to an inside surface of the hollow body 108 and encloses the opening 701. The cap member 707 includes a second material less dense than the first material.

In the embodiment depicted in FIG. 7, the opening 701 is contained within a recess 705 that is configured to retain the weight assembly 144. By way of description, the recess 705 has interior walls 723, i.e., walls that are not part of a surface of the sole 118. Preferably, the cap member 707 is fixed to cover the opening 701, e.g., attached by an adhesive such as epoxy.

A mechanical fastener 148 secures the weight assembly 144 against the support surface 129 of the first end 128 by drawing a retaining member 150 against the upper inner wall 133 of the channel. As the fastener 148 engages a threaded portion of the retaining member 150, a portion of the fastener (e.g., head) engages a portion of the weight assembly 144 and draws the weight assembly 144 in a direction towards the support surface 129 of the first end 128, as indicated by arrow 158. Similarly, the tightening action further draws the retaining member 150 in a direction towards the upper inner wall 133 of the channel 132, as indicated by arrow 160. The weight assembly 144 and the retaining member 150 are both drawn towards one another until both engage either side of a casting wall 156 which is formed by the support surface 129 and the upper inner wall 133. Accordingly, the weight assembly 144 and retaining member 150 effectively clamp the casting wall 156, thereby securing the weight assembly 144 against the support surface 129 of the first end 128 and the retaining member 150 against the upper inner wall 133 of the channel 132.

As previously described, the groove 134 may be shaped and/or sized to prevent rotation of the retaining member 150 therein, thereby allowing the fastener 148 to increase/decrease engagement (e.g., tighten or loosen) with the retaining member 150. The first end 140 of the channel 132 provides sufficient clearance for an end of the fastener 148, as indicated by arrow 154. In the illustrated embodiment, the first end 128 has a shape corresponding to a shape and/or contour of the weight assembly 144.

Figure 8:
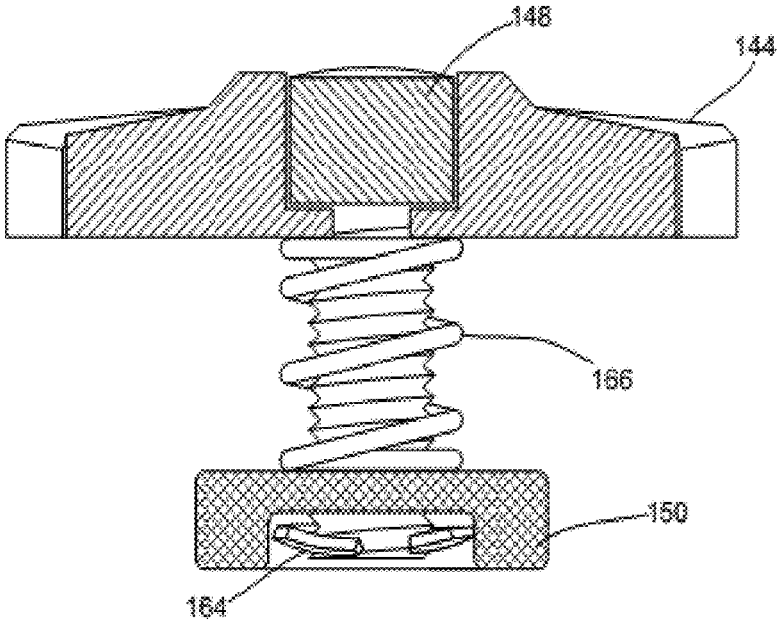
FIG. 8 is a sectional view of a weight assembly of the invention.

FIG. 8 is a sectional view of a weight assembly 144 using a spring 166 positioned between the weight assembly 144 and the retaining member 150. Upon tightening the fastener 148 to the retaining member 150, the weight assembly 144 and retaining member 150 are drawn towards one another, such that the spring 166 is compressed and stores mechanical energy, applying a biasing force against at least the weight assembly 144. In the event that a golfer wishes to move the weight assembly from one position to another, the golfer will loosen engagement between the fastener 148 and retaining member 150. Upon loosening the fastener 148, the spring 166 applies biasing force against the weight assembly 144 in a direction away from the retaining element 150, thereby resulting in the weight assembly 144 being forced in a direction away from the retaining member 150. Accordingly, when the golfer loosens the fastener 148 to move the weight assembly from a first position to a second position, for example, the spring 166 is adapted to effectively force the weight assembly out of engagement with the first end 128 of the track 126. Thus, the incorporation of the spring element 166 may essentially ease the repositioning process of the weight assembly.

With reference back to FIG. 5, it will be appreciated that track 126 extends along the sole 118 of club head 102. As shown in FIG. 7, track 126 occupies space above the sole 118 when the club head 102 is at address (i.e., FIG. 7 is upside-down relative to a club at address). That is, the track 126 protrudes into the club head 102. As such, to the extent that any material of track 126 is denser than air, the inclusion of track 126 will tend to raise the center of gravity of club head 102 at address relative to a club head that is similar but lacking in such a track. By including a cap member 707 comprising a lighter material than the surrounding material of the sole 118, the center of gravity of the club head 102 is lowered, at address, relative to a club head with a monolithically formed track 126 and sole 118. Thus by including an internal cap of a material lighter than the surrounding sole, a golf club can have an adjustability mechanism without so severely compromising the mass distribution properties (e.g., without raising the center of gravity higher than is preferred by many golfers). Additionally, looking at the area of sole 118 shown in FIG. 7 to illustrate, it will be appreciated that the described construction is much easier to mold or cast than a similar club head but in which cap 707 is of one piece with the material of sole 118. Thus the invention provides a golf club head 102 that includes a hollow, wood-type club head body 108 having a face 122, hosel 106, crown portion 116, and sole portion 118. The club head 102 includes an adjustment mechanism accessible at the sole 118 and extending into the club head body 108 relative to the sole 228. A cap member 707 sits over the adjustment mechanism, attached to the club head body, and recessed into the club head 102. The cap member 707 houses the adjustment mechanism on the outside of an enclosed volume defined by the club head body 108 and the cap member 707 (that is, the club can be adjusted from the outside by manipulating mass elements located outside of the overall internal volume defined by the club head 102). In the embodiment depicted in, e.g., FIG. 5, the adjustment mechanism includes a weight track 126 extending in a fore-aft direction. The invention additionally provides methods of making a golf club head with a lightweight internal cap.

Figure 9:
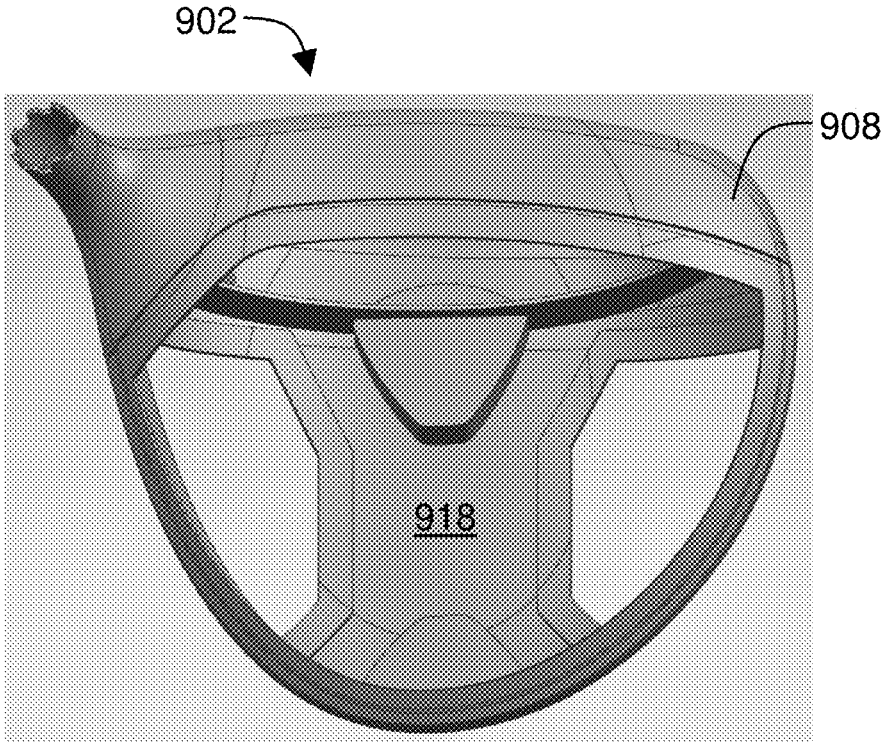
FIG. 9 illustrates a component for a club head body for a golf club head.

FIG. 9 illustrates a component for a club head body 908 for a golf club 902 according to certain embodiments. To make a golf club of the invention, the club head body 908 is formed. Any suitable method can be used to form club head body 908 including for example molding, casting, 3D printing, direct laser metal sintering, forging, stamping, or any other suitable method. The body member 908 may be made to include one or more recesses to become part of an adjustment mechanism.

Figure 10:
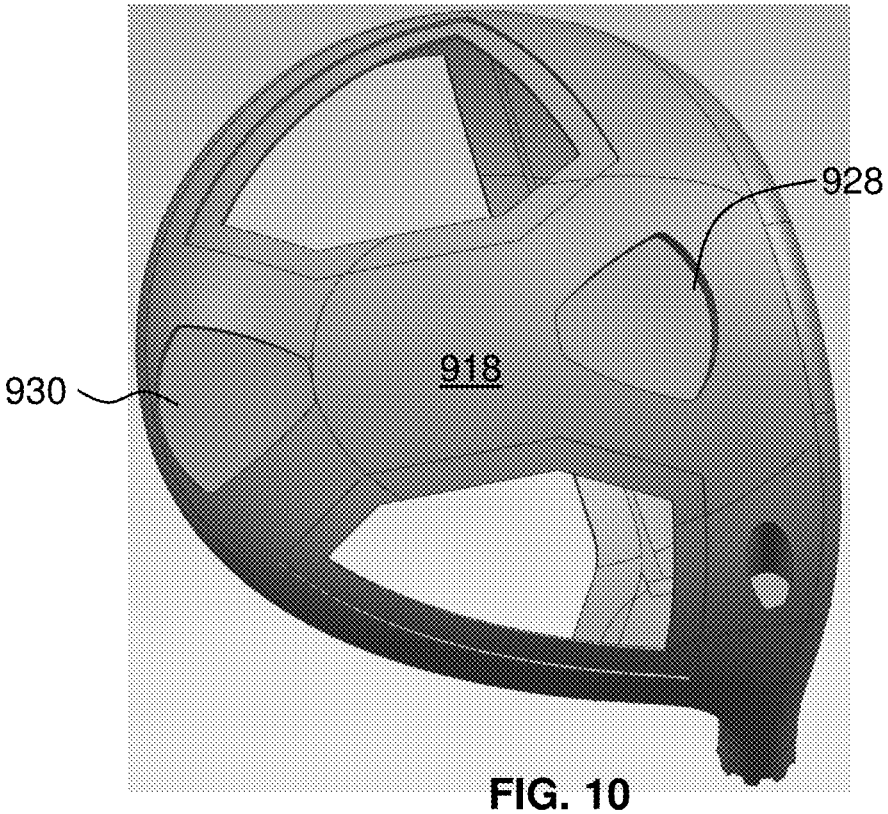
FIG. 10 depicts a club head body formed with recesses.

FIG. 10 depicts a club head body 908 formed with a first recess 928 and a second recess 930. Preferably the recesses are formed as part of a molding or casting. In some embodiments, club head body 908 is cast of titanium as shown in FIG. 10. Method of the invention further includes creating an opening through the club head body 908.

Figure 11:
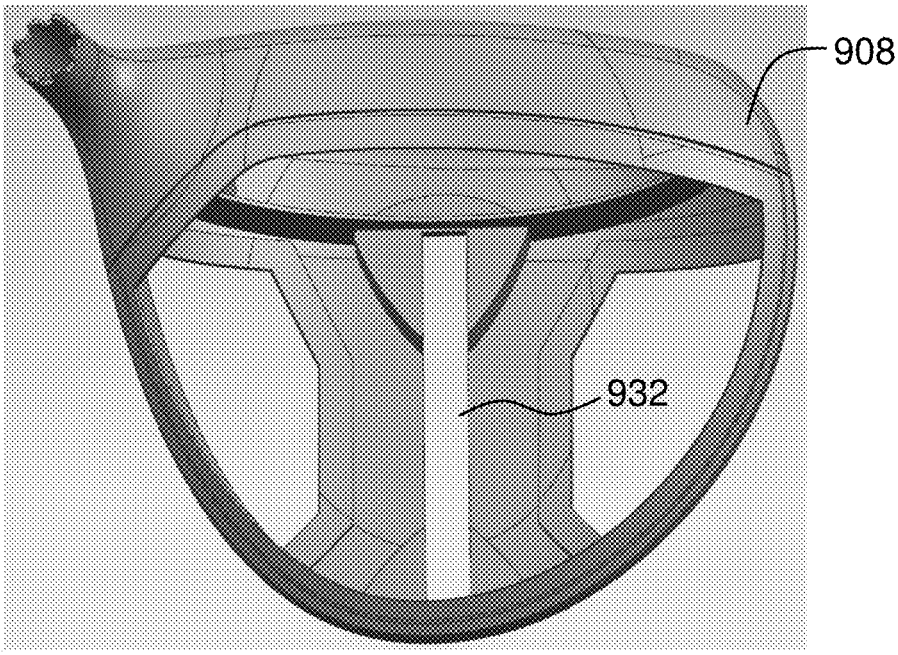
FIG. 11 shows a club head body with a channel opening.

FIG. 11 shows a club head body 908 with a channel opening 932.

Figure 12:
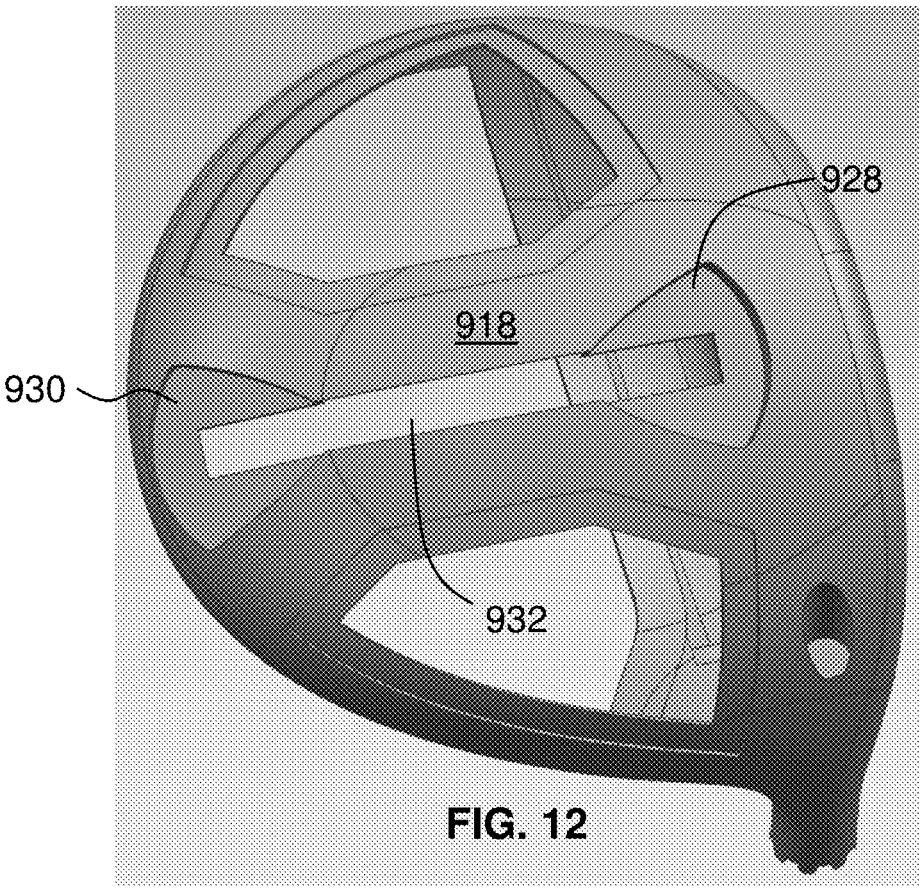
FIG. 12 shows the channel opening in a sole of a club head body.

FIG. 12 shows the channel opening 932 in a sole 918 of the club head body 908. A trench or opening 932 is cut through the casting, e.g., by laser cutting. A cap is then fixed (e.g., epoxied) into the head to encapsulate the trench.

Figure 13:
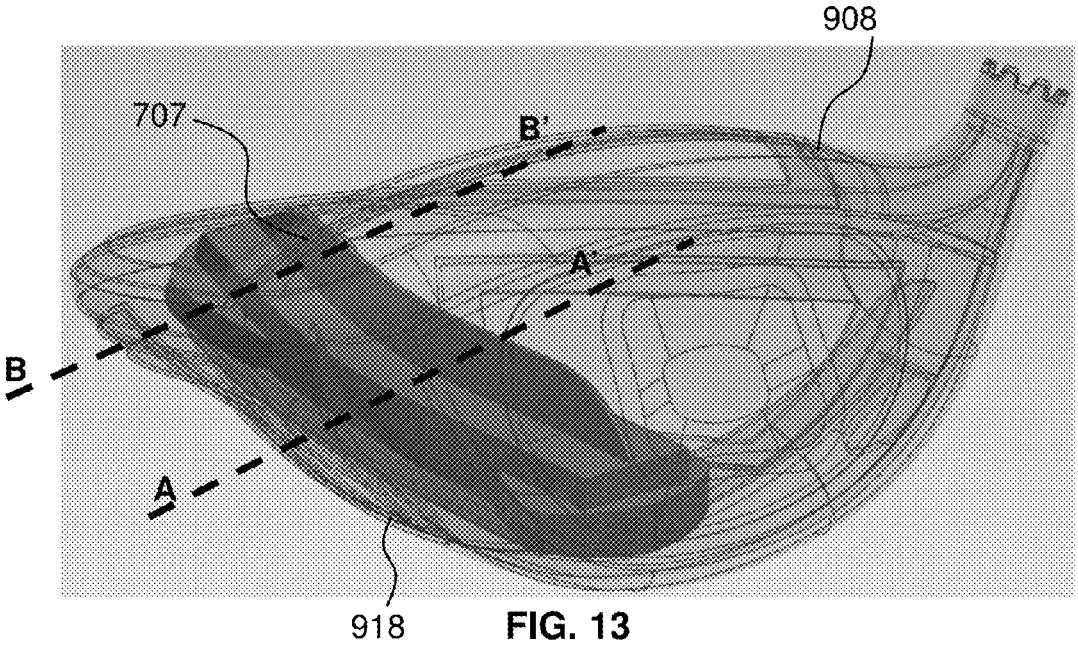
FIG. 13 gives a wire-frame view of a club head body that includes a cap member.

FIG. 13 gives a wire-frame view of a club head body 908 that includes a cap member 707 mounted on an inside surface of the sole 918.

Figure 14:
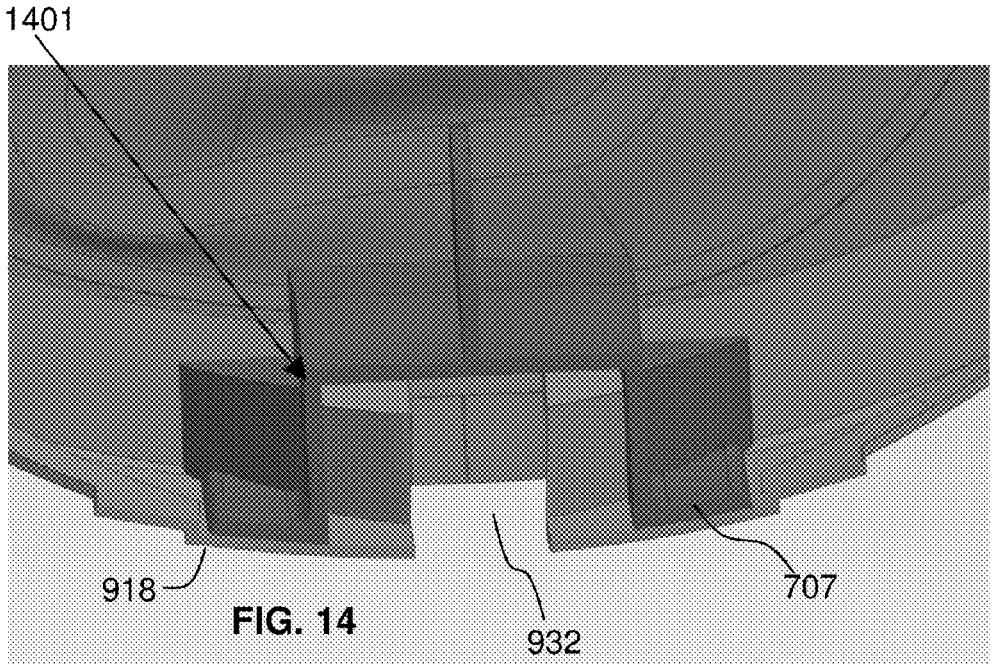
FIG. 14 gives a cross-sectional view through the cap member along a portion of the weight track.

FIG. 14 gives a cross-sectional view through the cap member 707 along a portion of the weight track and a portion of the sole 918 of the club head. As shown in FIG. 14, the cap member 707 covers, or encloses, the channel opening 932. In the illustrated embodiment, cap member 707 has a box profile 1401. By including a box-shaped portion 1401 in cap member 707 (e.g., along all of or part of a length of cap 707 where cap 707 is elongated or defining all of cap member 707 where cap member covers a discrete recess), the box-shaped portion 1401 is able to accommodate the weight assembly 144 (see e.g., FIG. 7 illustrating that the fastener 148 and the retaining member 150 are accommodated at least in part by and housed by the cap 707). It is not strictly required for box-like portion 1401 to have squared off walls and that portion may exhibit an arch shape, or C shape or inverted V shape or other suitable shape.

Figure 15:
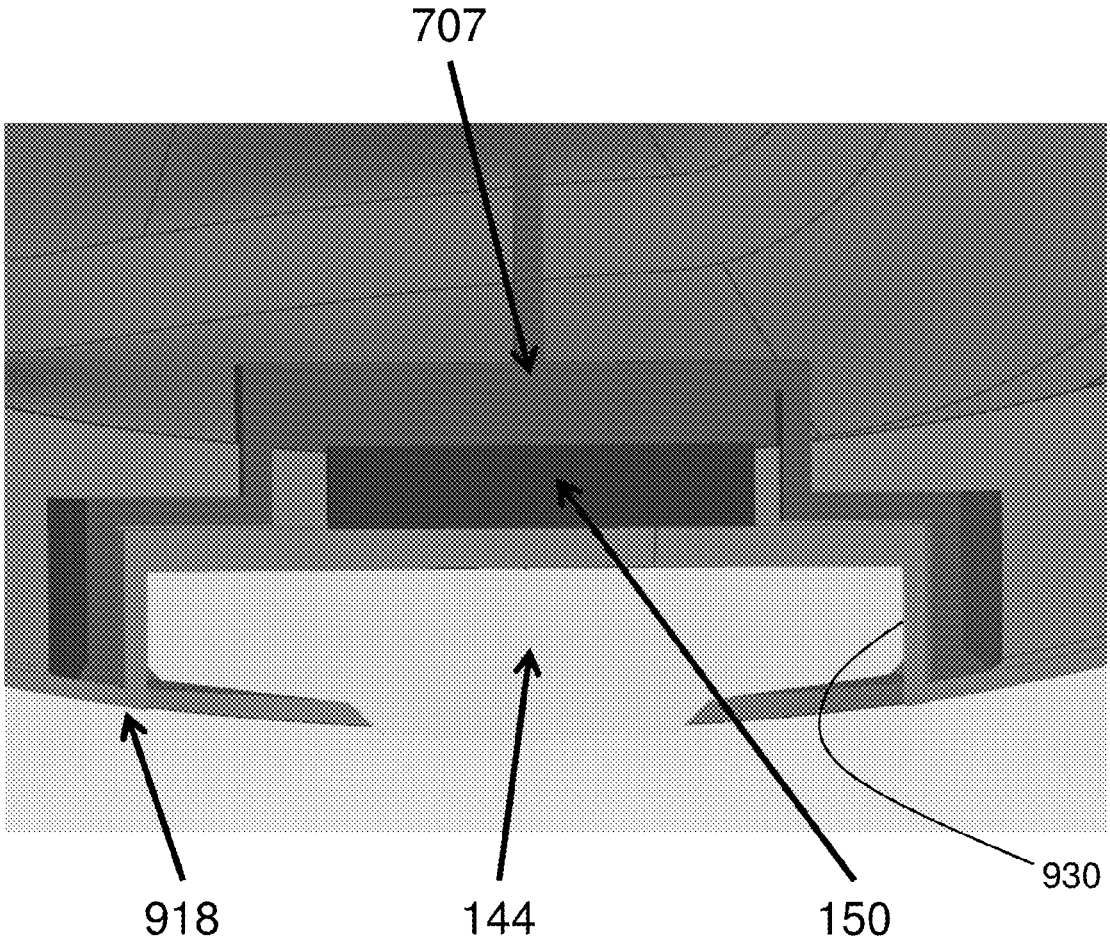
FIG. 15 gives a cross sectional view through the cap member along a line through a recess in a sole.

FIG. 15 gives a cross sectional view through the cap member 707 along line B-B' (as shown in FIG. 13) through second recess 930 (as shown in FIG. 12). It can be seen that cap 707 accommodates and covers weight assembly 144, particularly the retaining member 150 of the weight assembly 144.

While the foregoing embodiment relates to an internal cap 707 that covers an elongated recess such as a weight track, an internal cap may also or separately be used to cover a "discrete" recess—i.e., a recess that does not define an elongated track or channel that provides for sliding motion of an adjustment mechanism.

Figure 16:
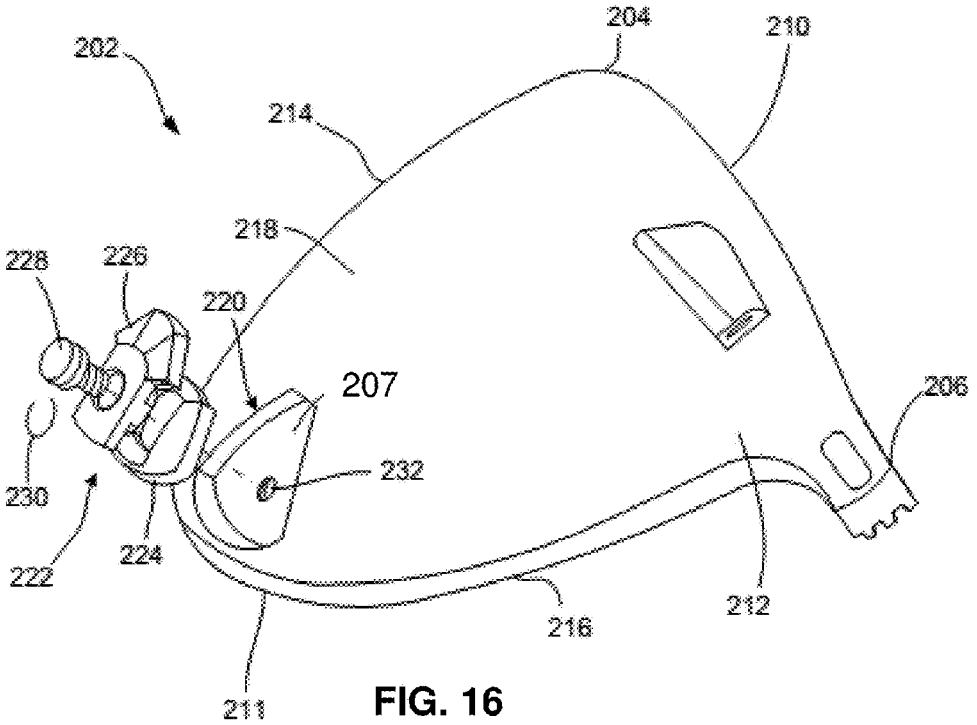
FIG. 16 gives a perspective view of a golf club head and weight assembly.

FIG. 16 gives a perspective view of a golf club head 202 having a weight assembly 222 attachable to a discrete recess providing a weight mounting portion 220 on a sole 218 of the club head 202. Club head 202 has a club head body 204 having a hosel 206, a face 210, a crown 216, and a sole 218. The club head generally includes a rear portion 211, a heel portion 212, and a toe portion 214. The recess 220 is formed on the sole 218 as a weight mount point and is shaped to receive a weight assembly 222. The recess 220 is covered or enclosed by cap member 207.

Figure 17:
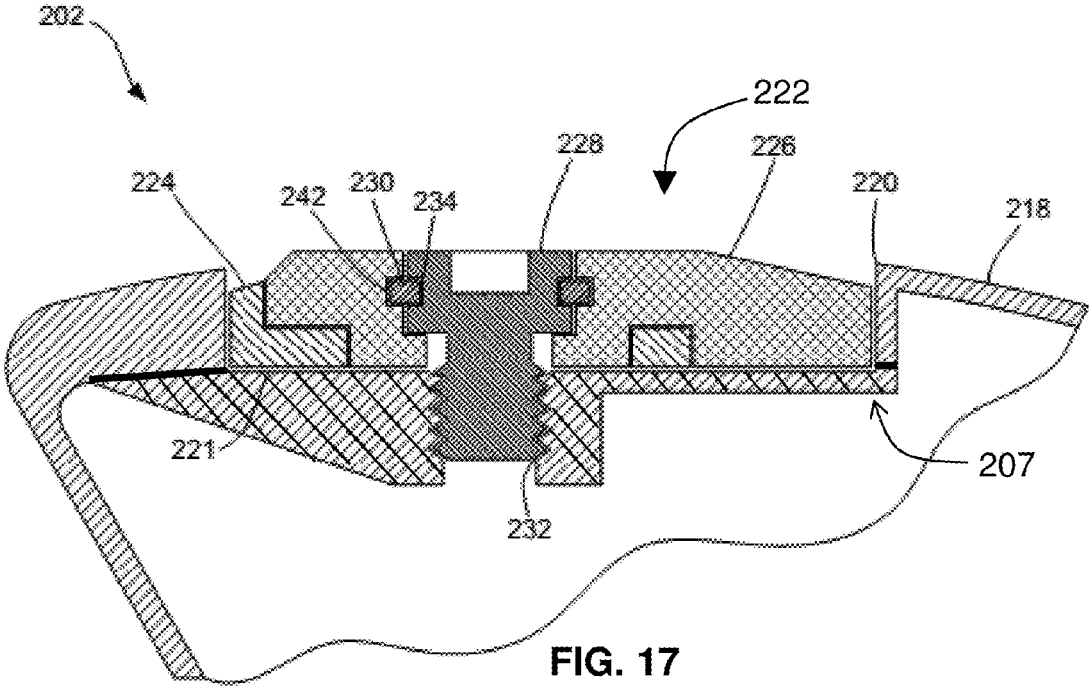
FIG. 17 shows a cross sectional view through a recess and a cap member.

FIG. 17 shows a cross sectional view through recess 220 and cap member 207 of club head 202. FIG. 17 gives more detail of the weight assembly 222. The assembly includes mechanical fastener 228 engaging a threaded aperture here shown to be provided by cap member 207. The weight assembly 222 has a base member 224 shaped to receive a weight insert 226 and the fastener. The weight insert 226 also includes a bore 238 to receive the fastener. The fastener 228 is threaded to engage bore 232. The fastener 228 further includes a channel 234 on its head to receive a retaining element 230 (e.g., spring clip). The weight insert 226 also includes a channel 242 formed along an inner surface of the bore 238, such that when the fastener 228 is positioned within the weight assembly 222 in an assembled state, the spring clip 230 is positioned and retained between the channels 234, 242.

As shown in FIG. 17, cap member 207 is mounted to an inside surface of sole 218. The fastener 228 engages bore 232 within cap member 207. The surrounding area of sole 218 includes a first material such as a metal (e.g., Ti). The cap member 207 includes a second material, preferably unlike the first material (e.g., lighter or less dense).

FIG. 17 shows the weight assembly 222 securely coupled to the weight mounting portion 220. As shown, the weight assembly 222 may include a weight member 226 housed within a cavity of the outer cover 224. As shown, the outer cover 244 and weight member 246, each include a bore shaped to receive the fastener 228. Additionally, a channel 242 is defined along an inner surface of the weight member 226. The channel 242 is shaped to receive the spring clip 230, such that, when the fastener 228 is positioned within the weight assembly 222 in an assembled state, the spring clip 230 is positioned and retained, thereby securing the fastener 228 to the weight assembly 222.

The outer cover 244 and weight member 246 may be secured to one another via press-fit, bonding with adhesives or cements, welding (e.g., laser welding), soldering, brazing, or other fusing techniques, etc., such that they are fixed to one another. The support member 248 may be formed from a foam or other supportive material and may be secured to the base of the weight member 246 and outer cover 244 by way of adhesive. The support member 248 may be adapted to provide a supportive interface between the weight assembly 222 and the weight mounting portion 220 and further dissipate and/or manage vibration, rattling, and/or sound.

It should be noted that all embodiments of a weight assembly consistent with the present disclosure may be coupled to the fastener by way of a retaining element (e.g., spring clip). For example, the weight assembly 144 may be coupled to the fastener 148 by way of the spring clip 230. In particular, the bore 146 of the weight assembly 144 may include a channel formed along an inner wall and a corresponding channel may be formed on an outer surface of the head of the fastener 148, wherein each of the channels is shaped and/or sized to receive a portion of the spring clip 130 within. The spring clip may first be placed in either of the channels prior to insertion of the head of the fastener 148 within the bore 146 of the weight assembly 146. Accordingly, upon insertion of the head of the fastener 148 into the bore 146 of the weight assembly 144, the spring clip is received within the channels of the bore 146 and the head of the fastener 148, thereby coupling the weight assembly 144 to the fastener 148, while still allowing rotation of the fastener 148.

In certain embodiments, the invention provides a golf club head with an adjustment mechanism and a cap member in the club head, housing the adjustment mechanism, and in which the adjustment mechanism provides a weight track in the sole with a plurality of distinct positions for a repositionable weight. The club may further include a repositionable weight member capable of being fixed at a plurality of positions along the weight track.

Figure 18:
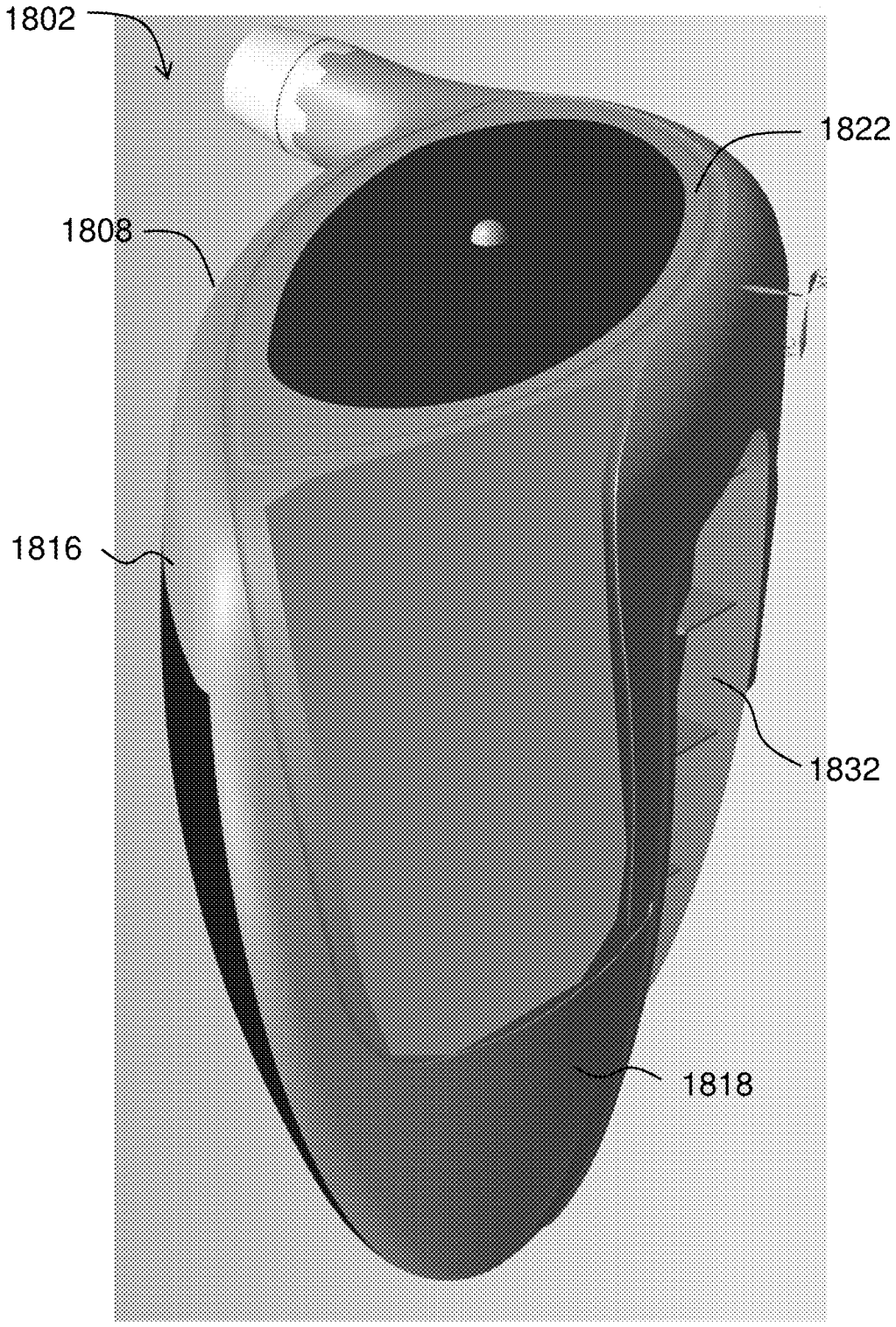
FIG. 18 shows golf club head according to certain embodiments.

FIG. 18 shows golf club head 1802 that includes a hollow, wood-type club head body 1808 having a face 1822, hosel 1806, crown portion 1816, and sole portion 1818. The club head 1802 includes an adjustment mechanism 1832 accessible at the sole 1818 and extending into the club head body 1808 relative to the sole 1818. A cap member 1807 covers the adjustment mechanism 1832 from the inside of the club head body 1808.

Figure 19:
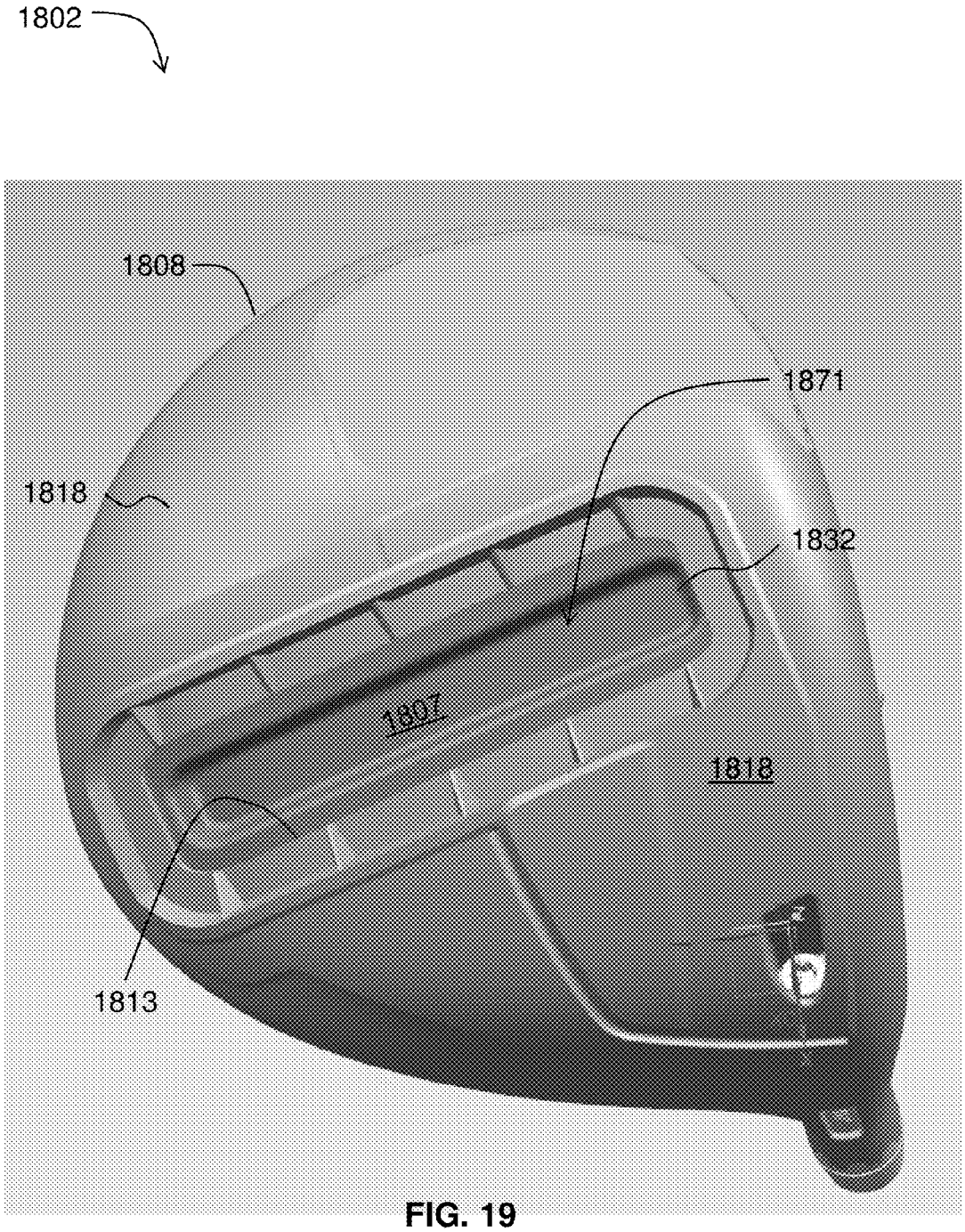
FIG. 19 shows that the adjustment mechanism includes a weight track.

FIG. 19 shows that the adjustment mechanism 1832 includes a weight track 1826 provided by edges 1813 along sides of an opening 1871 through the sole 1818. The weight track 1826 extends in a fore-aft direction. Using a weight member such as the one shown in FIG. 8, club head 1802 preferably includes a repositionable weight member 144 capable of being fixed at a plurality of positions along the weight track.

Figure 20:
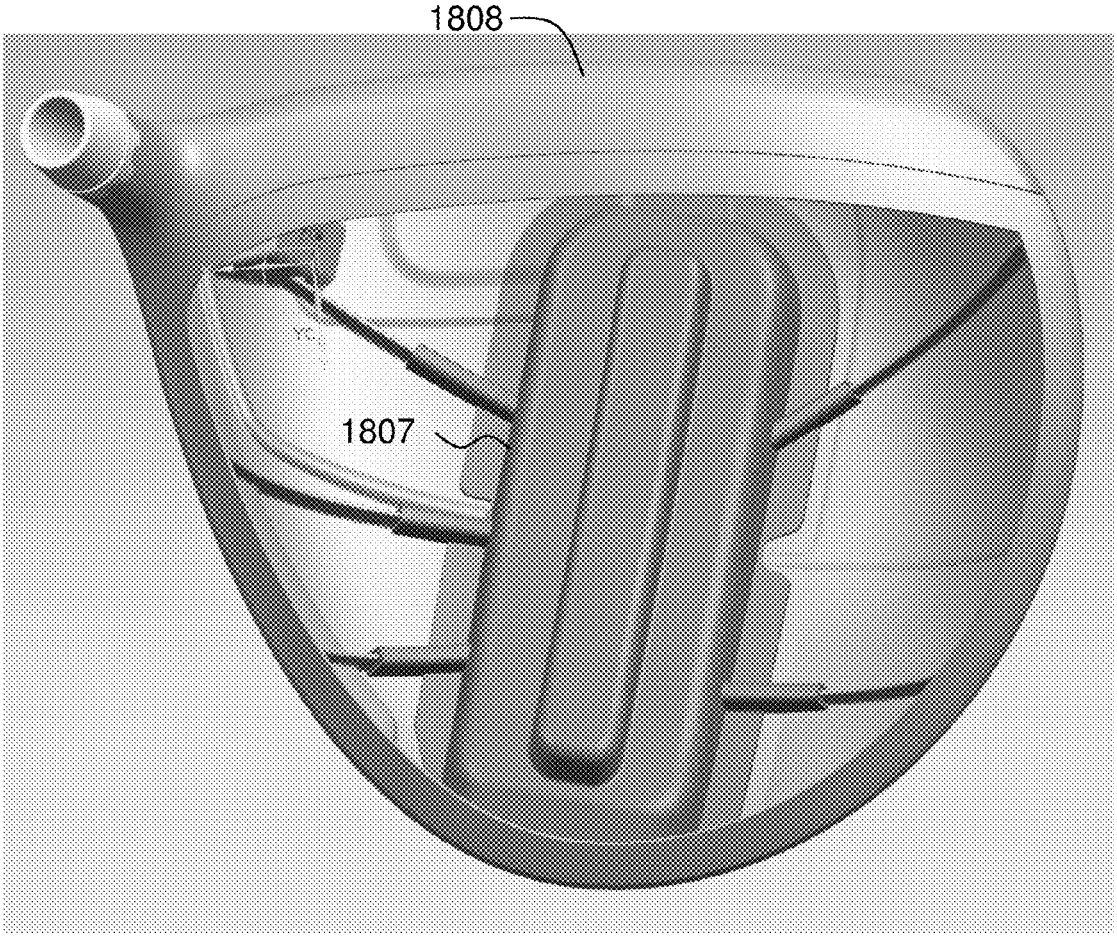
FIG. 20 shows a cap member from inside of the club head.

FIG. 20 shows the cap member 1807 covering the adjustment mechanism 1832 from the inside of the club head. The cap member 1807 is attached to the club head body 1808, and recessed into the club head. The cap member 1807 houses the adjustment mechanism 1832 on the inside of the overall club head but on the outside of an enclosed volume defined by the club head body 1808 and the cap member 1807. In a preferred embodiment, the sole 1818 comprises a metal such as titanium and the cap 1807 includes a polymer and is fixed to the sole by an adhesive such as epoxy. It should be understood that the cap member 1807 can be said to enclose the sole or cover the adjustment mechanism as the adjustment mechanism is preferably structured to otherwise define a hole through the club head body 1808, i.e., include an aperture but for the presence of the cap member 1807.

Figure 21:
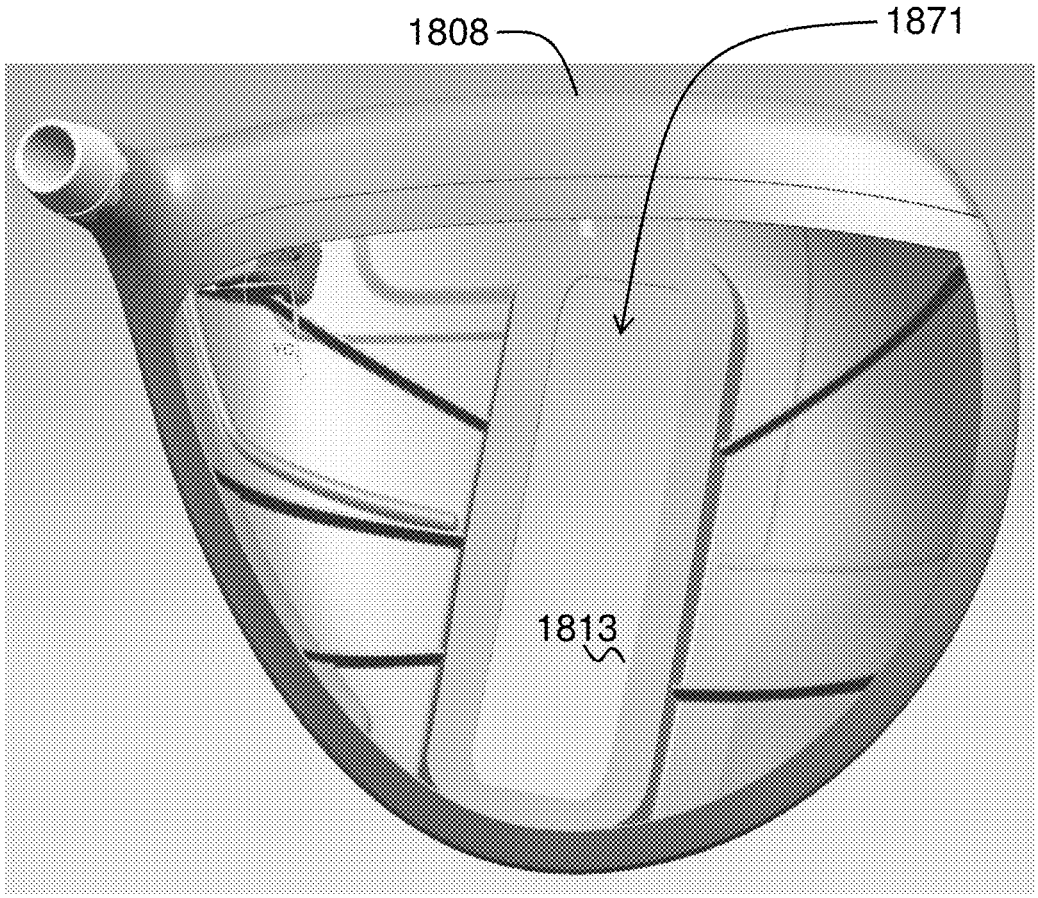
FIG. 21 shows the opening in a sole of a club head.

FIG. 21 shows the opening 1871 is in the sole 1818 of club head 1802 and edges 1813 of the opening provide a track 1826 for a repositionable weight. The weight track 1826 and the cap member 1807 cooperate to define an exposed ledge or edge 1813. In a preferred embodiment, the exposed edge defines an undercut in that space is left behind the exposed edge, between the inside of the sole and the cap member. This undercut accommodates the retaining member 150 of a weight assembly and provides a structure for the weight assembly to grip to, i.e., provides purchase for a removable or repositionable element.

Figure 22:
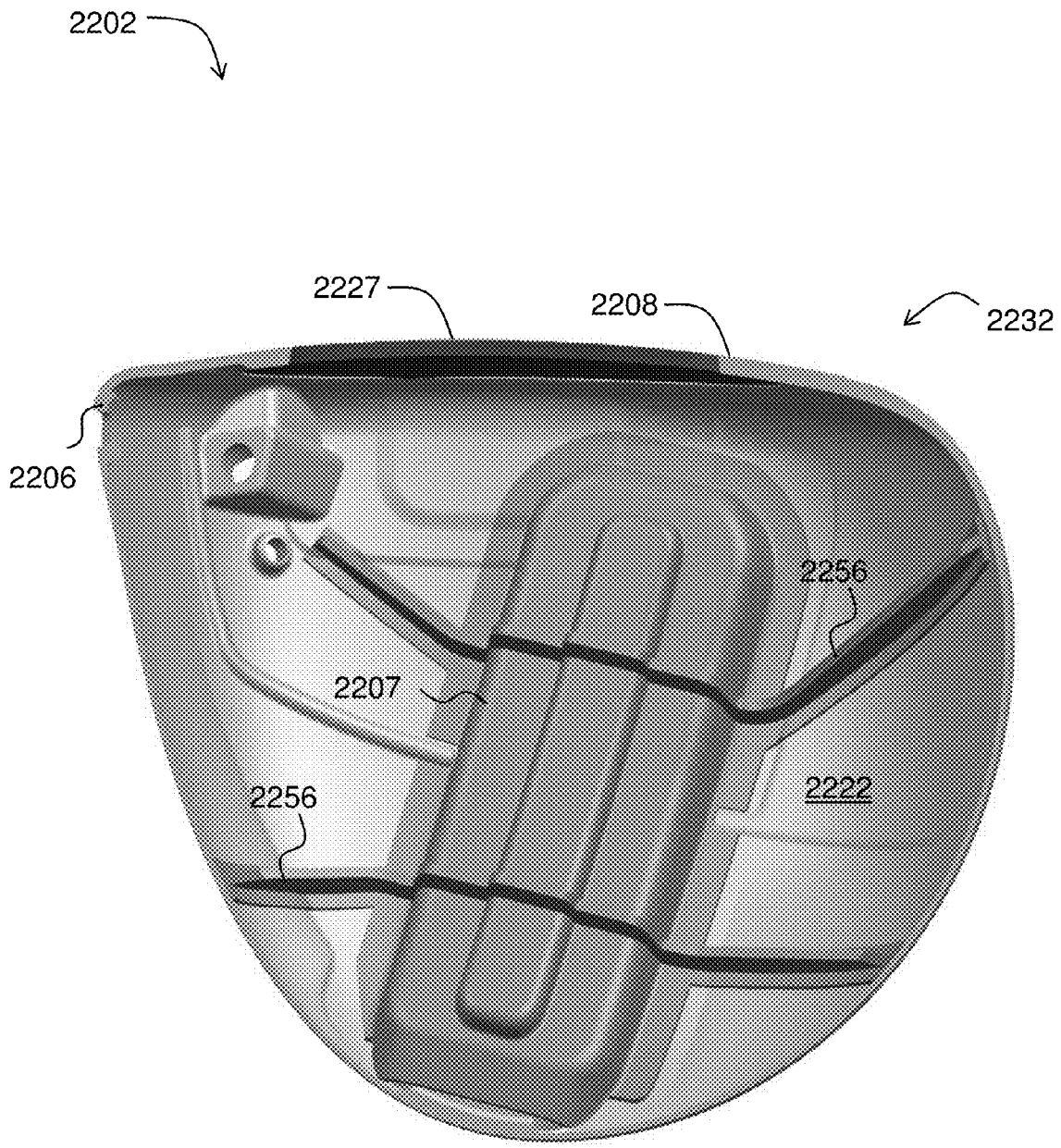
FIG. 22 shows a cap member from inside of the club head and having at least one rib extending over or through it.

FIG. 22 shows golf club head 2202 that includes a hollow, wood-type club head body 2208 having a face 2227, hosel 2206, crown portion (not pictured), and sole portion 2222. The club head 2202 includes an adjustment mechanism 2232 accessible at the sole 2222 and extending into the club head body 2208 relative to the sole 2222. A cap member 2207 covers the adjustment mechanism 2232 from the inside of the club head body 2208. The cap member 2207 includes at least one rib 2256 extending over or through it.

Ribs 2256 may provide stiffening elements to the cap structure 2207. Advantages of including the ribs 2256 may include that they are lighter than having metal ribs cast into the club head. Additionally, ribs 2256 may be found to provide additional bonding ledge area. Further, the inclusion of one or more ribs 2256 on cap 2207 avoids manufacturing problems that may be associated with undercuts, rib sink, or rib shadow (e.g., on exterior surface). Also, including a rib 2256 on cap 2207 provide the ability to easily mold different shapes such as T-ribs.

It can be seen from the foregoing that the invention provides various embodiments of a golf club head with an opening covered from within by a lightweight cap. The opening can be part of, e.g., a weight track. The club head includes a crown, sole, face, and hosel cooperating to define a hollow club head body comprising at least a first material. The club head has an opening through the hollow body. Part of an edge around the opening is provided by a first material and a cap member of a second material less dense than the first material is mounted e.g., by an adhesive to an inside surface of the hollow body and enclosing the opening. The described construction is easier to mold or cast that other forms featuring undercuts and does not unduly interfere with a club head center of gravity.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a crown, sole, face, and hosel, cooperating to define a hollow club head body comprising at least a first material;

a recess provided by the first material and disposed along a length of the club head body, the recess comprising a channel extending inwardly from an exterior surface of the club head body and having interior sidewalls extending inwardly from the exterior surface and terminating at a bottom wall, the bottom wall having an opening extending therethrough and into an interior cavity of the hollow body, wherein the opening comprises a perimeter entirely defined by an edge that extends uninterrupted about the perimeter around the opening;

a cap member mounted within the interior cavity of the hollow body and secured to an interior surface thereof in a fixed position to thereby cover the entire opening in the bottom wall of the channel of the recess and, in combination with the recess, form a track for receiving a slidable weight assembly therein, wherein the cap member comprises a flange portion defined along a perimeter of the cap member and a box-shaped portion extending from the flange portion, wherein the flange portion is secured to the interior surface of the club head body along a perimeter of the recess and the box-shaped portion is spaced a distance away from the opening in the bottom wall of the channel of the recess to thereby form a groove portion of the track; and a weight assembly slidably coupled to the track, the weight assembly comprises a weight member positioned within the recess and coupled to a portion of the track by way of a fastener extending through a portion of the weight member, through the opening defined in the bottom wall of the channel, and engaging an internally threaded retaining member permanently retained within the groove portion of the track and configured to slide therein, wherein the weight member is adapted to move along a length of the track via the slidable retaining member and further be releasably fixed at a plurality of positions along the length of the track.

2. The golf club head of claim 1, wherein the cap member comprises a second material less dense than the first material.

3. The golf club head of claim 2, wherein the first material comprises a metal and the second material comprises a polymer.

4. The golf club head of claim 1, wherein the recess is provided along a length of the sole of the club head, wherein the weight member is repositionably mounted within the channel and slidable along a length of the channel between at least two positions.

5. The golf club head of claim 4, wherein the channel extends from a forward portion of the sole proximal to the face to an aft portion of the sole distal to the face.

6. The golf club head of claim 1, wherein the golf club head is a driver-type club head.

7. The golf club head of claim 1, wherein the cap member is attached to an inside surface of the hollow body by an adhesive.

8. The golf club head of claim 1, wherein the track extends in a fore-aft direction.

* * * * *